US008408565B2

(12) United States Patent
An

(10) Patent No.: US 8,408,565 B2
(45) Date of Patent: Apr. 2, 2013

(54) HINGE STRUCTURE OF SKATEBOARD

(76) Inventor: Na Eun An, Inchon (KR)

( * ) Notice: Subject to any disclaimer, the term of this patent is extended or adjusted under 35 U.S.C. 154(b) by 324 days.

(21) Appl. No.: 12/993,898

(22) PCT Filed: Apr. 11, 2009

(86) PCT No.: PCT/KR2009/001870

§ 371 (c)(1),
(2), (4) Date: Nov. 22, 2010

(87) PCT Pub. No.: WO2009/134020

PCT Pub. Date: Nov. 5, 2009

(65) Prior Publication Data

US 2011/0131759 A1 Jun. 9, 2011

(30) Foreign Application Priority Data

Apr. 28, 2009 (KR) ..... 10-2008-0039179

(51) Int. Cl.
*A63C 17/00* (2006.01)

(52) U.S. Cl. ..... 280/87.05; 280/87.042

(58) Field of Classification Search ..... 280/87.05, 280/87.042

See application file for complete search history.

(56) References Cited

U.S. PATENT DOCUMENTS

| | | | | | |
|---|---|---|---|---|---|
| 781,243 | A * | 1/1905 | Thompson | 280/651 |
| 3,583,722 | A * | 6/1971 | Jacobson | 280/16 |
| 4,076,267 | A * | 2/1978 | Lipscomb | 280/87.042 |
| 4,082,306 | A * | 4/1978 | Sheldon | 280/87.042 |
| 4,458,907 | A * | 7/1984 | Meredith | 280/87.042 |
| 5,505,474 | A * | 4/1996 | Yeh | 280/87.042 |
| 5,540,455 | A * | 7/1996 | Chambers | 280/87.042 |
| 5,769,438 | A * | 6/1998 | Svetlov | 280/87.041 |
| 5,826,895 | A * | 10/1998 | Bradfield | 280/87.042 |
| 6,131,931 | A * | 10/2000 | Globerson et al. | 280/87.042 |
| D505,470 | S * | 5/2005 | Hong | D21/765 |
| 7,083,178 | B2 * | 8/2006 | Potter | 280/87.042 |
| 7,150,461 | B2 * | 12/2006 | Schnuckle et al. | 280/87.05 |
| 7,195,259 | B2 * | 3/2007 | Gang | 280/87.042 |
| 7,325,819 | B2 * | 2/2008 | Kwak | 280/87.042 |
| 7,367,572 | B2 * | 5/2008 | Jiang | 280/87.042 |
| 7,523,955 | B2 * | 4/2009 | Blair | 280/656 |
| 7,635,137 | B2 * | 12/2009 | Gregory et al. | 280/87.05 |
| 7,775,534 | B2 * | 8/2010 | Chen et al. | 280/87.042 |
| 7,976,034 | B1 * | 7/2011 | Hong et al. | 280/87.042 |
| 8,047,556 | B2 * | 11/2011 | Jang et al. | 280/87.042 |
| 2010/0225080 | A1 * | 9/2010 | Smith | 280/87.042 |
| 2011/0236607 | A1 * | 9/2011 | Woncik | 428/12 |
| 2012/0068427 | A1 * | 3/2012 | Alva | 280/87.05 |

* cited by examiner

*Primary Examiner* — Jeffrey J Restifo

(74) *Attorney, Agent, or Firm* — Lexyoume IP Meister, PLLC.

(57) ABSTRACT

The present invention relates to a hinge structure of a skateboard, and more specifically, to a hinge structure of a skateboard wherein an intermediate part of the skateboard divided into two parts that are a front board and a rear board is connected by a hinge unit. Accordingly, the skateboard is twisted and the skateboard's alignment is elastically returned by a cam and spring of the hinge unit, thereby increasing propelling force and durability. Also, since assembly and disassembly of the hinge unit is easy when the skateboard is broken, convenient maintenance and repair are enabled.

8 Claims, 4 Drawing Sheets

HINGE STRUCTURE OF SKATEBOARD

TECHNICAL FIELD

The present invention relates to a hinge structure of a skateboard, and more particularly, to a hinge structure of a skateboard of which two parts of a front board and a rear board are connected by a hinge unit and are elastically restored from a twisted state by a cam and a spring of the hinge unit, thereby enhancing driving force and durability. In addition, the hinge unit can be easily assembled and disassembled when the skateboard is out of order, thereby improving maintenance and repair characteristics of the skateboard.

BACKGROUND ART

In general, a skateboard includes a longitudinal oval plate and two sets of wheels each having two rollers mounted on the bottom of the plate. This conventional skateboard can be accelerated by a rider's stamping on the ground at the time of straightly traveling and can be steered by the rider's leaning to left and right sides at the time of turning.

However, such a conventional skateboard cannot be accelerated without the rider's stamping on the ground, but can be accelerated by only an extremely skillful rider's leaning to left and right sides in the traveling direction. When the plate is inclined to a side to some extent at the time of turning, the wheels and the plate come in contact with the ground and thus the plate has not to be inclined much. Accordingly, the radius of rotation thereof is great.

Therefore, a skateboard divided into a front board and a rear board has been recently proposed to solve such a problem. The skateboard divided into two parts includes a plate divided into a front board and a rear board, a hinge unit connecting the front board and the rear board, and casters movably mounted on the bottoms of the divided boards.

Such a skateboard divided into two parts is disclosed in U.S. Pat. No. 4,076,267, U.S. Pat. No. 4,082,306, JP-UM-A-1-117385, JP-UM-A-13-29663, and Korean Patent Nos. 394848 and 505754. On the other hand, the technique of accelerating a skateboard divided into two parts by twisting the skateboard is disclosed in U.S. Pat. No. 1,056,357 and Korean Unexamined Patent Application Publication No. 2002-28361.

The publications disclose a structure in which a skateboard is divided into two boards, the divided boards are connected by an elastic hinge unit, and casters are mounted on the bottoms of the boards. In the publications, the skateboard is accelerated by twisting the divided boards to left and right sides in the traveling direction, the hinge unit has a simple restoring force against the twist, and the hinge unit is coupled to the boards using bolts and nuts. Accordingly, it is difficult to assemble and disassemble the skateboard and thus to replace the hinge unit due to damage or the like.

Since the skateboard divided into two boards is accelerated by twisting the skateboard, the durability of the hinge unit is very important. However, the skateboard divided into two boards has a restoring force against the twist as an elastic deformation and thus the restoring force against the elastic deformation deteriorates due to the use for a long term. Accordingly, it may not become possible to drive the skateboard in a desired direction, thereby causing often disorders and destruction of the skateboard.

Therefore, there is a need for a hinge unit of a skateboard divided into two boards, which can provided a good acceleration force and highly durability against the twist and can be easily disassembled and assembled, thereby simplifying the maintenance and repair.

DISCLOSURE OF THE INVENTION

Technical Problem

Therefore, the invention is made to solve the above-mentioned problems and an object of the invention is to provide a hinge structure of a skateboard which can improve the durability and the elastic restoring force against the twist by the use of a hinge cam and a hinge spring, thereby providing a great acceleration force.

Another object of the invention is to provide a hinge structure of a skateboard which can be easily assembled and disassembled to rapidly cope with destruction or the like due to continuous twist, thereby simplifying the maintenance and repair.

Technical Solution to Problem

To accomplish the above-mentioned object, according to an aspect of the invention, there is provided a hinge structure of a skateboard comprising a hinge unit that fixes a front board and a rear board in a separated state and elastically restoring the front board and the rear board against twist and casters that are mounted on the bottoms of the front board and the rear board, the hinge unit (H) including: a first hinge housing (100) that is formed in the rear board (RB) and has a hollow portion (102) of which an end is opened to face the front board (FB); a second hinge housing (200) that is formed in the front board (FB) and has a hinge cylinder 202 of which an end is opened to face the rear board (RB); a hinge shaft (300) that is coupled to the first hinge housing (100) at one end and is coupled to the second hinge housing (200) with a bolt at the other end; at least one bearing (B) that is coupled to the hinge shaft (300); a fixed hinge cam (400) that is axially coupled to the hinge shaft (300) and one end of which is inserted into the hollow portion (102) of the first hinge housing (100) and the other end has a fixed contact portion 402 obliquely cut to form an elliptical shape; a movable hinge cam (500) that is axially coupled to the hinge shaft (300) and has a movable contact portion (502) having a shape corresponding to the fixed contact portion (402) of the fixed hinge cam (400), wherein the movable contact portion (502) rotates along the fixed contact portion (402) so as to be movable in the axial direction in the hinge cylinder (202) of the second hinge housing (200); a hinge spring (600) that is safely coupled to the inside of the hinge cylinder (202), is disposed between the movable hinge cam (500) and the hinge cylinder (202), and applies an elastic force to the movable hinge cam (500); and a fixing and coupling member (700) that is coupled to the ends of the front board (FB) and the rear board (RB) facing each other with a bolt so as to prevent the hinge shaft (300) from being departing from the first and second hinge housings (100 and 200).

Here, the second hinge housing (200) may include the hinge cylinder (202) to which the hinge spring (600) is safely coupled and of which one end is opened so that the movable hinge cam 500 is movable in the axis direction, and the hinge cylinder may include: a safe support step (204) that has a step formed at the other end of the hinge cylinder (202) so as to support the hinge spring (600); a shaft insertion hole (206) that is longitudinally recessed in the axis direction of the safe support step (204) with a reduced diameter and into which an end of the hinge shaft (300) is inserted; and a bolt hole (208)

that is formed at the inner end of the shaft insertion hole (206) so as to pass through the second hinge housing (200).

On the other hand, the hinge shaft (300) may include: a rotational axis portion (310) that is inserted into the hollow portion (102) of the first hinge housing (100) so as to be movable therein; and a movement guiding axis portion 320 that has a diameter smaller than that of the rotational axis portion (310), that guides the movable hinge cam (500) so as to be movable forward and backward in the axis direction, and has a coupling hole (322) formed to be coupled and fixed to the second hinge housing (200) with a bolt. In addition, the fixed hinge cam (400) may have a cylindrical shape and include: a fixed contact portion (402) of which one end is obliquely cut to form an elliptical surface; a fixed axis hole (404) that communicate from one end to the other end so as to be axially coupled to the hinge shaft 300; and a fixed protrusion (406) that is inserted into and fixed to the fixing and coupling member (700) coupled to an end of the rear board (RB) and is formed on both edges of the opposite end of the fixed contact portion (402).

The movable hinge cam (500) may have a cylindrical shape and include: a movable contact portion (502) that is obliquely cut along the elliptical surface of the fixed contact portion (402) of the fixed hinge cam (400) to form an elliptical surface; and a movable axis hole (504) that communicates from one end to the other end so as to be axially coupled to the hinge shaft 300. On the other hand, the movable contact portion (502) of the movable hinge cam (500) corresponding to the fixed contact portion (402) of the fixed hinge cam (400) may be twisted in the obliquely-cut elliptical surface of the fixed contact portion 402 in the angle range of 0 degree to 90 degree about the hinge shaft (300).

On the other hand, the fixing and coupling member (700) may include: a first fixed plate (710) that is coupled to the end surface of the hollow portion (102) of the first hinge housing at the end of the rear board (RB) with a bolt, has a hinge shaft hole (712) formed at the center, and has fixed key grooves (714) formed on both inner edges of the hinge shaft hole (712); a second fixed plate (710') that is formed in the second hinge housing (200) at the end of the front board (FB), is coupled to the end surface of the hinge cylinder 202 of which the end is opened along with the end of the second hinge housing (200) with a bolt, and has a hinge shaft hole (712') formed at the center; and a fixing bolt (720) that is inserted into a bolt hole (208) communicating with a shaft insertion hole (206) from the bottom surface of the second hinge housing (200) and is coupled to a coupling hole (322) formed at an end of the movement guiding axis portion (320) of the hinge shaft 300 so as to fix the movement guiding axis portion (320) to the shaft insertion hole (206) of the second hinge housing (200).

On the other hand, a snap ring (SR) may be further provided to prevent the at least one bearing (B) disposed at an end of the hinge shaft (300) from departing from the first hinge housing (100).

Advantageous Effect

According to the above-mentioned configurations, with the twist made by a rider at the time of driving the skateboard, the movable hinge cam forward and backward moves on the hinge shaft in the axis direction like a piston by the use of the valley-shaped portion of the fixed hinge cam and the ridge-shaped portion of the movable hinge cam and the driving force is generated by the elastic restoring force of the hinge spring, thereby improving the durability and the driving force.

The skateboard can be easily assembled and disassembled to rapidly cope with the destruction of the hinge unit due to the successive twist at the time of driving the skateboard, thereby simplifying the maintenance and repair.

DESCRIPTION OF REFERENCE NUMERALS AND SIGNS

100: FIRST HINGE HOUSING
102: HOLLOW PORTION
200: SECOND HINGE HOUSING
202: HINGE CYLINDER
204: SAFE SUPPORT STEP
206: SHAFT INSERTION HOLE
208: BOLT HOLE
300: HINGE SHAFT
310: ROTATIONAL AXIS PORTION
320: MOVEMENT GUIDING AXIS PORTION
322: COUPLING HOLE
400: FIXED HINGE CAM
402: FIXED CONTACT PORTION
404: FIXED AXIS HOLE
406: FIXED PROTRUSION
500: MOVABLE HINGE CAM
502: MOVABLE CONTACT PORTION
504: MOVABLE AXIS HOLE
600: HINGE SPRING
700: FIXING AND COUPLING MEMBER
710: FIRST FIXED PLATE
712: HINGE SHAFT HOLE
714: FIXED KEY GROOVE
710': SECOND FIXED PLATE
712': HINGE SHAFT HOLE
720: FIXING BOLT
H: HINGE UNIT
FB: FRONT BOARD
RB: REAR BOARD
B: BEARING
SR: SNAP RING

DESCRIPTION OF EXEMPLARY EMBODIMENTS

The configuration and operation of a hinge structure of a skateboard according to an embodiment of the invention will be described in detail with reference to the accompanying drawings.

Figure 1:
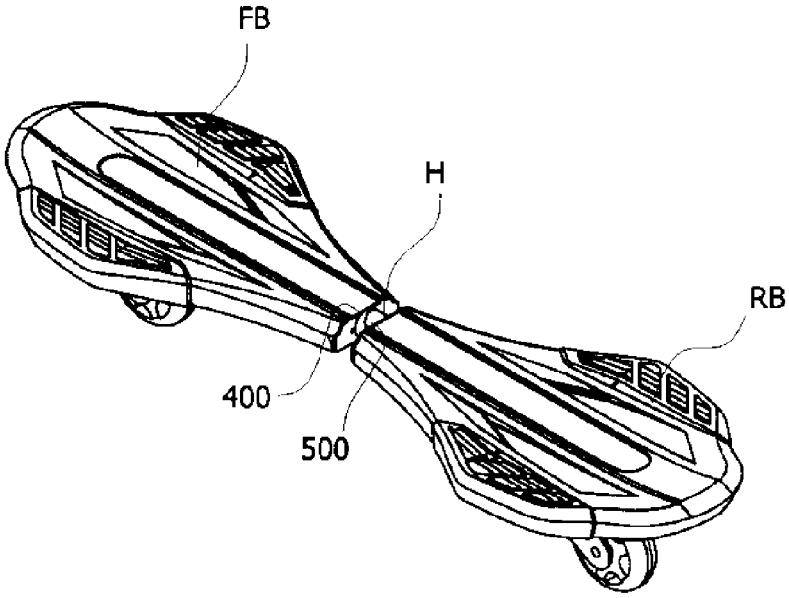
FIG. 1 is a perspective view illustrating a hinge structure of a skateboard according to an embodiment of the invention.
Figure 2:
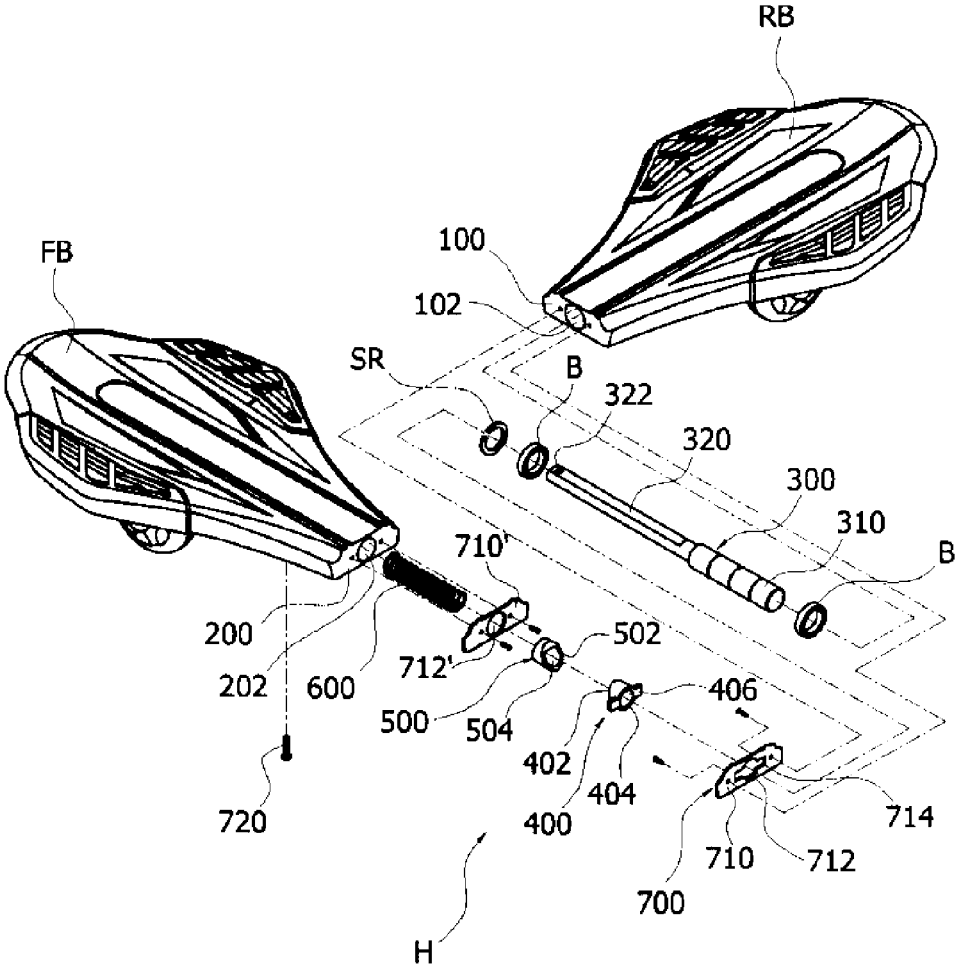
FIG. 2 is an exploded perspective view of the hinge structure of a skateboard according to the embodiment of the invention.
Figure 3:
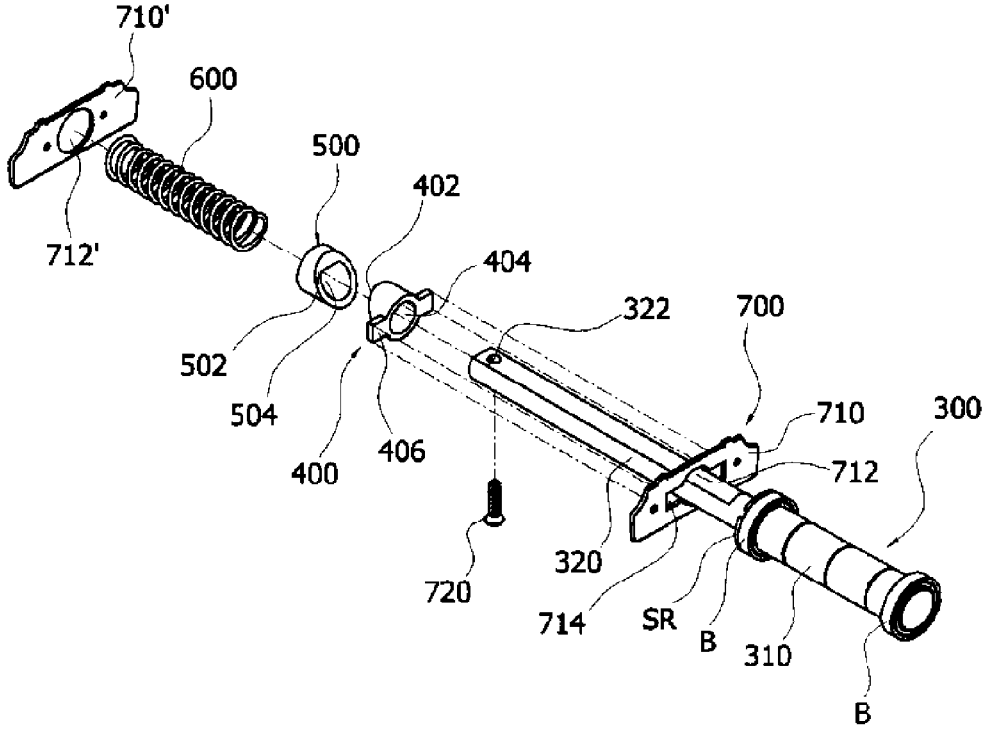
FIG. 3 is a partially=enlarged perspective view of the hinge structure of a skateboard according to the embodiment of the invention.
Figure 4:
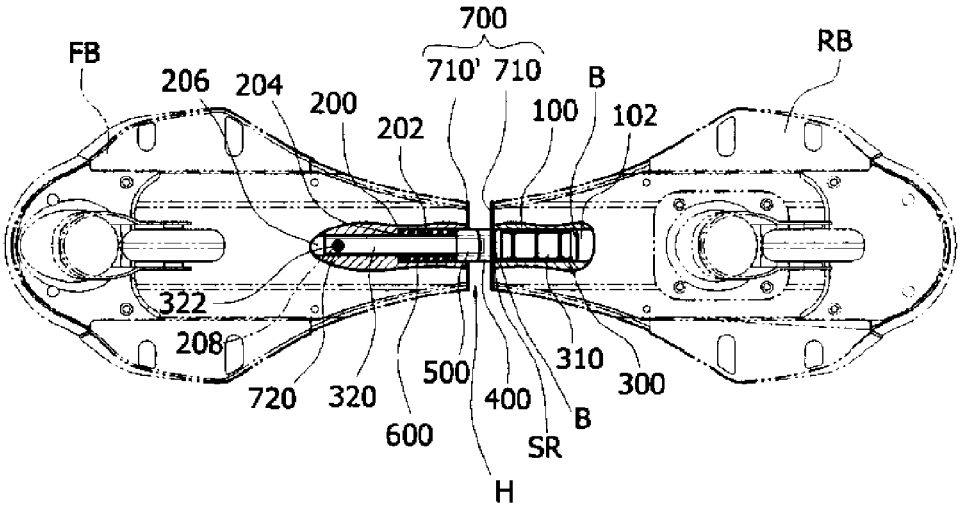
FIG. 4 is a top view of the hinge structure of a skateboard according to the embodiment of the invention.
Figure 5:
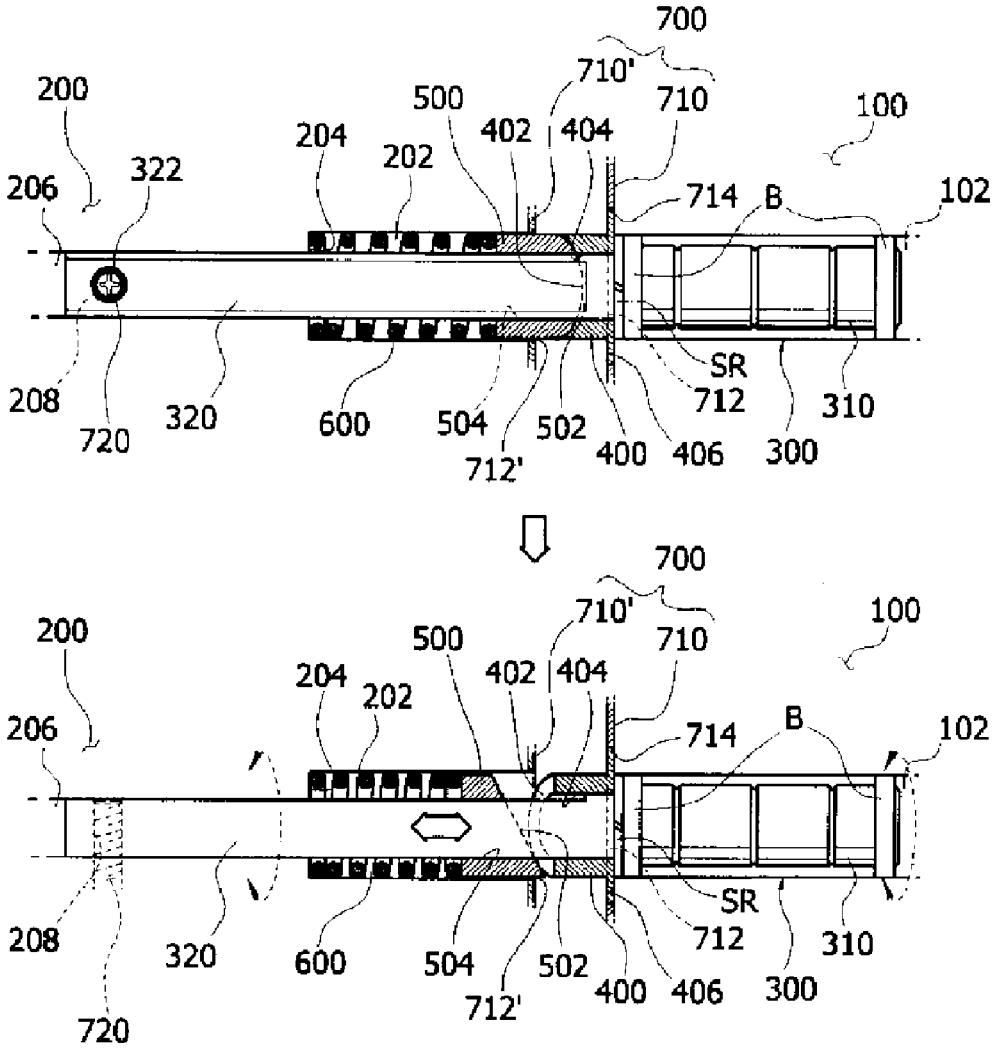
FIG. 5 is a sectional view illustrating operating states of the hinge structure of a skateboard according to the embodiment of the invention.
Figure 6:
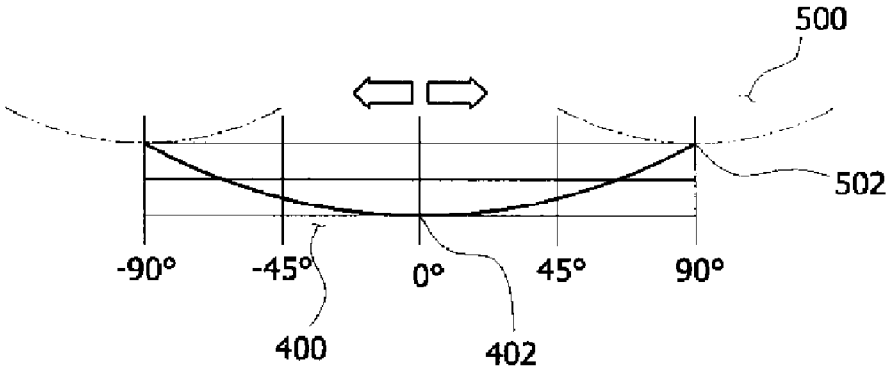
FIG. 6 is a diagram illustrating a cam profile of the hinge structure of a skateboard according to the embodiment of the invention.
Figure 7:
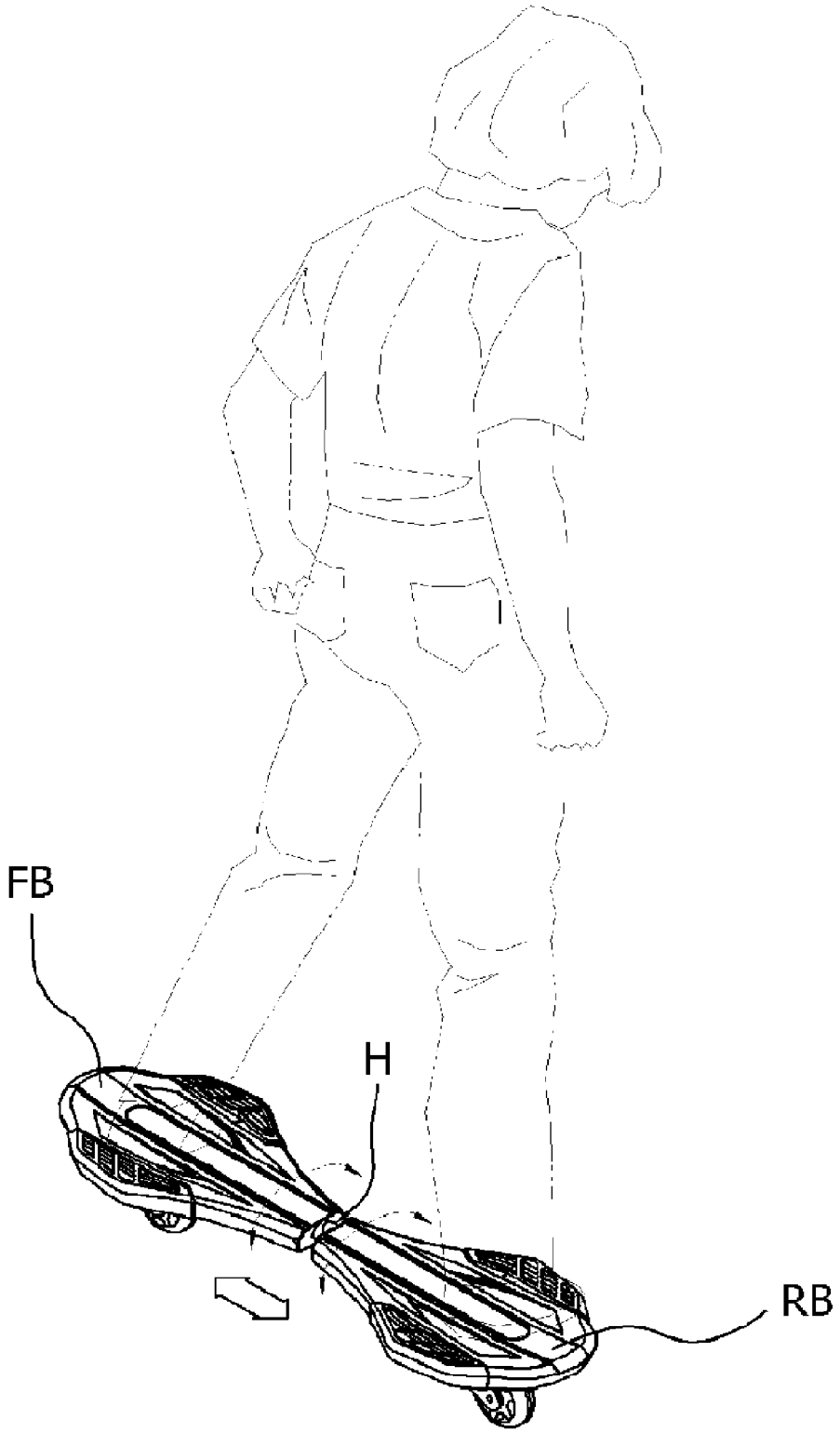
FIG. 7 is a diagram illustrating a usage of the hinge structure of a skateboard according to the embodiment of the invention.

FIG. 1 is a perspective view illustrating a hinge structure of a skateboard according to an embodiment of the invention. FIG. 2 is an exploded perspective view of the hinge structure of a skateboard according to the embodiment of the invention. FIG. 3 is a partially=enlarged perspective view of the hinge structure of a skateboard according to the embodiment of the invention. FIG. 4 is a top view of the hinge structure of a skateboard according to the embodiment of the invention. FIG. 5 is a sectional view illustrating operating states of the hinge structure of a skateboard according to the embodiment of the invention. FIG. 6 is a diagram illustrating a cam profile of the hinge structure of a skateboard according to the embodiment of the invention. FIG. 7 is a diagram illustrating a usage of the hinge structure of a skateboard according to the embodiment of the invention.

As shown in FIGS. 1 to 4, the skateboard according to an embodiment of the invention includes a hinge unit fixing a front board FB and a rear board RB in a separated state and being elastically restored against the twist and casters mounted on the bottoms of the front board and the rear board. Here, the hinge unit H of the hinge structure of the skateboard according to the embodiment of the invention includes a first hinge housing 100 disposed in the front board FB, a second hinge housing 200 disposed in the rear board RB, a hinge shaft 300, a bearing B, a fixed hinge cam 400, a movable hinge cam 500, a hinge spring 600, and a fixing and coupling member 700.

The first hinge housing 100 is formed in the rear board

RB to face the front board FB and includes a hollow portion 102 of which one end is opened. Here, the fixing and coupling member 700 to be described later is coupled to one end surface of the hollow portion 102 of the first hinge housing and is fixed to the rear board RB.

The second hinge housing 200 is formed in the front board FB to face the rear board RB. Here, the second hinge housing 200 includes a hinge cylinder 202, a safe support step 204, a shaft insertion hole 206, and a bolt hole 208.

An end of the hinge cylinder 202 is opened along with an end of the second hinge housing 200. The hinge spring 600 to be described later is disposed in the hinge cylinder 202, and the movable hinge cam 500 to be described later is disposed to be movable in the hinge cylinder 202 in the axis direction as if a piston plug moves in a piston cylinder of a syringe.

On the other hand, the safe support step 204 is provided by forming a step with a reduced diameter at the other end of the hinge cylinder 202 so as to safely support the hinge spring 600 to be described later. Here, the safe support step 204 serves as a point of action of an elastic force of the hinge spring 600.

The shaft insertion hole 206 is longitudinally recessed with a reduced diameter along the center axis of the safe support step 204 so as to insert an end of the hinge shaft 300 into the shaft insertion hole. The bolt hole 208 is formed at the inner end of the shaft insertion hole 206 so as to pass from the outside of the front board FB to the shaft insertion hole 206.

On the other hand, the hinge shaft 300 is movably inserted into the first hinge housing 100 and is coupled to the second housing 200 with a bolt, thereby connecting the front board FB and the rear board RB. Here, the hinge shaft 300 includes a rotational axis portion 310 and a movement guiding axis portion 320.

The rotational axis portion 310 is movably inserted into the hollow portion 102 of the first hinge housing 100. That is, when a rider twists the rear board RB, the rotation axis portion 310 is inserted into the hollow portion 102 so as to twist the rear board RB without any friction.

The movement guiding axis portion 320 has a diameter smaller than that of the rotational axis portion 310, is axially coupled to the movable hinge cam 500, is guided to move in the axis direction. A coupling hole 322 is disposed at an end of the movement guiding axis portion 320 so that the movement guiding axis portion 320 inserted into the shaft insertion hole 206 of the second hinge housing 200 is coupled and fixed to the second hinge housing 200 by the use of a fixing bolt 720 of the fixing and coupling member 700 inserted from the outside of the front board FB.

One or more bearings B are coupled to the rotational axis portion 310 of the hinge shaft 300 to minimize the frictional force between the rotational axis portion 310 and the rear board RB at the time of twisting the rear board RB. Here, as shown in the drawings, the bearings B are coupled to the front and rear ends of the hinge shaft 300 so as to guarantee the structural stability in the twisting movement of the rotational axis portion 310 of the hinge shaft 300 and the rear board RB.

On the other hand, a snap ring SR used to prevent the bearings B coupled to the rotational axis portion 310 from departing is coupled to the boundary between the rotational axis portion 310 and the movement guiding axis portion 320 of the hinge shaft 300.

The fixed hinge cam 320 is coupled to the movement guiding axis portion 310 at the boundary between the rotational axis portion 310 and the movement guiding axis portion 320 of the hinge shaft 300, and is inserted into and fixed to the fixing and coupling member 700 coupled to an outer end of the hollow portion 102 of the first hinge housing 100. Here, the fixed hinge cam 400 includes a fixed contact portion 402 that is formed in a cylindrical shape and that is obliquely cut to form an elliptical surface. A fixed axis hole 404 communicating from one end to the other end is formed at the center so as to be axially coupled to the movement guiding axis portion 320 of the hinge shaft 300.

Fixed protrusions 406 inserted into the fixing and coupling member coupled to one end surface of the first hinge housing 100 and fixed to the rear board RB are formed on both sides of the surface of the fixed hinge cam 400 opposite to the fixed contact portion 402.

The movable hinge cam 500 is coupled to the movement guiding axis portion 320 of the hinge shaft 300 and one end thereof is inserted into the hinge cylinder 202 of the second hinge housing 200 so as to be slidable. Here, the movable hinge cam 500 moves on the elliptical surface of the fixed contact portion 402 of the fixed hinge cam 400 so as to be movable in the axis direction. The movable hinge cam 500 includes a movable contact portion 502 obliquely cut to form an elliptical shape along the fixed contact portion 402 of the fixed hinge cam 400 and to face the fixed contact portion.

On the other hand, the movable hinge cam 500 has an elliptical shape and includes a movable axis hole 504 communicating from one end to the other end so as to move in the axis direction by the use of the movable contact portion 502 that is axially coupled to the movement guiding axis portion 320 of the hinge shaft 300 and that moves on the elliptical surface of the fixed contact portion 402 as described above. The movable contact portion 502 of the movable hinge cam 500 corresponding to the fixed contact portion 402 of the fixed hinge cam 400 preferably moves on the elliptical surface of the fixed contact portion 402 in the angle range of 0 degree to 90 degree about the hinge shaft 300 with the rider's twisting the skateboard.

The hinge spring 600 is inserted into the hinge cylinder 202 of the second hinge housing 200 so that it is pressurized by the movable hinge cam 500 to apply a driving force to the rear board RB by action and reaction based on the elastic force thereof. Here, one end of the hinge spring 600 is safely coupled to a safe support step 204 stepped to form the shaft insertion hole 206, whereby the elastic force is applied to the rear board RB. The hinge spring 600 is preferably formed of a coil spring generating the elastic force against the pressurization so as to satisfactorily generate the driving force.

The fixing and coupling member 700 includes a first fixed plate 710, a second fixed plate 710', and a fixing bolt 720 so as to prevent the hinge shaft 300 from departing from the first and second hinge housings and to couple the front board FB and the rear board RB to face each other.

Here, the first fixed plate 710 is coupled to an outer edge surface of the hollow portion 102 of the first hinge housing at an end of the rear board RB with a bolt and includes a hinge shaft hole 712 formed at the center thereof and fixed key grooves 714 formed on both sides of the inner edge of the hinge shaft hole 712 so as to insert the fixed protrusions 406 of the fixed hinge cam 400 into the fixed key grooves.

The second fixed plate 710' is coupled to the end surface of the hinge cylinder 202 of the second hinge housing 200 at an end of the front board FB with a bolt and includes a hinge shaft hole 712' formed at the center.

That is, the hinge shaft hole 712 of the first fixed plate 710 coupled to the first hinge housing 100 has a diameter smaller than that of the rotational axis portion 310 of the hinge shaft 300 so as to prevent the rotational axis portion 310 of the hinge shaft 300 from departing from the hollow portion 102 of the first hinge housing 100. The fixed key grooves 714 are formed on both sides thereof so as to insert and fix the fixed protrusions 406 of the fixed hinge cam 400 into and to the fixed key grooves. Accordingly, the fixed hinge cam 400, the first fixed plate 710, and the rear board RB move as a body with the twist of the rear board RB.

The hinge shaft hole 712' of the second fixed plate 710' coupled to the hinge cylinder 202 of the second hinge housing 200 preferably has a diameter equal to or greater than that of the hinge cylinder 202 so that the movable hinge cam 500 can move in the hinge cylinder 202.

The fixing bolt 720 is coupled to the bolt hole 208 communicating with the shaft insertion hole 206 from the bottom of the second hinge housing 200 with a bolt and is coupled to the coupling hole 322 formed at one end of the movement guiding axis portion 320 of the hinge shaft 300, whereby the movement guiding axis portion 320 is fixed to the shaft insertion hole 206 of the second hinge housing 200.

The operation of the hinge structure of the skateboard according to the embodiment of the invention having the above-mentioned configuration will be described below with reference to examples of a use state.

As shown in FIG. 4, in the hinge structure of the skateboard according to the embodiment of the invention, the rotational axis portion 310 of the hinge shaft 300 is inserted into the hollow portion 102 of the first hinge housing 100 disposed in the rear board RB so as to be movable with the twist of the rear board RB. Here, one or more bearings B are coupled to the rotational axis portion 310 of the hinge shaft 300, which is then inserted into the hollow portion 102 of the first hinge housing of the rear board RB. At this time, the snap ring SR can be preferably coupled to the rotational axis portion 310 forming a step along with the movement guiding axis portion 320 of the hinge shaft 300 so as to prevent the bearings B from departing from the rotational axis portion 310.

Thereafter, the hinge shaft hole 712 is coupled to the movement guiding axis portion 320 of the hinge shaft 300, whereby the first fixed plate 710 of the fixing and coupling member 700 is coupled to the opened side of the first hinge housing 100 with a bolt and is fixed to one end surface of the rear board RB.

Here, the hinge shaft hole 712 of the fixed plate 710 has a diameter smaller than that of the hollow portion 102 so as to prevent the rotational axis portion 310 inserted into the hollow portion 102 from departing therefrom due to the successive twist and external impact.

Then, the hinge spring 600 is safely inserted into the hinge cylinder 202 of the second hinge housing 200 disposed in the front board FB by the use of the safe support step 204. Thereafter, the second fixed plate 710' is coupled to the hinge cylinder 202 in which the hinge spring 600 is safely installed by the safe support step 204.

The fixed hinge cam 400 is axially coupled and fixed to the boundary stepped between the movement guiding axis portion 320 and the rotational axis portion 310 of the hinge shaft 300 by the use of the fixed axis hole 404. Here, the fixed protrusions 406 of the fixed hinge cam 400 are inserted into the fixed key grooves 714 of the first fixed plate 710 so as to fix the fixed hinge cam to the rear board RB.

The movable hinge cam 500 is inserted into the hinge shaft hole 712' of the second fixed plate 710' coupled to the hinge cylinder 202 of the second hinge housing 200 with a bolt, whereby an end of the movable hinge cam 500 is located inside the hinge cylinder 202.

The movement guiding axis portion 320 of the hinge shaft 300 is inserted into the shaft insertion hole 206 of the second hinge housing 200 through the movable axis hole 504 of the movable hinge cam 500.

The fixing bolt 720 is inserted into the bolt hole 208 from the bottom of the front board FB to the shaft insertion hole 206 so as to fix the movement guiding axis portion 320 inserted into the shaft insertion hole 206 to the front board FB, and is coupled and fixed to the coupling hole 322 of the movement guiding axis portion 320.

The front board FB and the rear board RB are connected by the hinge shaft 300, and the fixed hinge cam 400 and the movable hinge cam 500 are coupled to each other in the axis line of the hinge shaft 300. Here, the fixed contact portion 402 of the fixed hinge cam 400 is first located to correspond to the movable contact portion 502 of the movable hinge cam 500 to maintain level.

Therefore, in the hinge structure of the skateboard according to the embodiment of the invention assembled as described above, the movable contact portion 502 of the movable hinge cam 500 is located on the fixed contact portion 402 of the fixed hinge cam 400 to initially maintain level, as shown in FIG. 5.

In this state where the movable hinge cam 500 and the fixed hinge cam 400 maintaining level, when the rider places his or her feet on the front board FB and the rear board RB of the skateboard and twists the front board FB, the hinge shaft 300 coupled to the front board FB rotates in the axis line with the twist of the front board FB.

In this way, when the hinge shaft 300 rotates along with the front board FB, the movable hinge cam 500 coupled to the movement guiding axis portion 310 also rotates. Accordingly, when the front board FB is twisted, the movable hinge cam 500 disposed on the fixed contact portion 402 of the fixed hinge cam 400 rotates with the twist and the movable contact portion 502 is displaced on the elliptical surface of the fixed contact portion 402. Accordingly, the movable hinge cam 500 in the axis line of the movement guiding axis portion 320 of the hinge shaft 300 repeatedly moves forward and backward in the axis line of the hinge shaft 300.

That is, when the movable contact portion 502 of the movable hinge cam 500 is displaced on the elliptical surface of the fixed contact portion 402 of the fixed hinge cam 400, the distance between the fixed hinge cam 400 and the movable hinge cam 500 varies and thus the movable hinge cam 500 moves forward and backward in the axis line of the movement guiding axis portion 320 of the hinge shaft 300 toward the hinge cylinder 202 of the second hinge housing 200. Accordingly, one end of the movable hinge cam 500 moving toward the hinge cylinder 202 pressurizes the hinge spring 600.

When a rider changes the posture of the front board FB to a horizontal state, the movable hinge cam 500 moves on the elliptical surface of the fixed contact portion 402 of the fixed hinge cam 400 so as to move to the horizontal state along with the front board FB, the distance between he fixed hinge cam 400 and the movable hinge cam 500 becomes the shortest, and the elastic force of the hinge spring 600 is applied to the rear board RB to generate the driving force of the rear board RB.

That is, as shown in the profile illustrated in FIG. 6, the movable contact portion 502 of the movable hinge cam 500 moves in the angle range of 0 degree to −90 degree in the curved line of the fixed contact portion 402 of the fixed hinge cam 400 and the hinge spring 600 is repeatedly pressurized and restored by the movable hinge cam 500, whereby the driving force to the rear board RB is generated by the elastic restoring force of the hinge spring 600.

Therefore, as shown in FIG. 7, when a rider places his or her feet on the front board FB and the rear board RB of the skateboard having the hinge structure according to the invention and twists the front board and the rear board with snaps of ankles and legs, the hinge shaft 400 rotates and the movable hinge cam 500 rotates relative to the fixed hinge cam 400, thereby changing the distance between the movable hinge cam 500 and the fixed hinge cam 400.

With this change in distance between the movable hinge cam 500 and the fixed hinge cam 400, the movable hinge cam 500 moves in the axis direction of the hinge shaft 300 and the hinge spring 600 is repeatedly pressurized and restored accordingly to acquire the driving force. Even when the front board FB and the rear board RB are twisted at the same time, the same operation is caused.

While specific embodiments of the invention have been described, it will be obvious to those skilled in the art that the invention may be modified in various forms without departing from the scope of the invention and the modifications belongs to the scope of the appended claims.

The invention claimed is:

1. A hinge structure of a skateboard comprising a hinge unit that fixes a front board and a rear board in a separated state and elastically restoring the front board and the rear board against twist and casters that are mounted on the bottoms of the front board and the rear board, the hinge unit (H) including:

a first hinge housing (100) that is formed in the rear board (RB) and has a hollow portion (102) of which an end is opened to face the front board (FB);

a second hinge housing (200) that is formed in the front board (FB) and has a hinge cylinder 202 of which an end is opened to face the rear board (RB);

a hinge shaft (300) that is coupled to the first hinge housing (100) at one end and is coupled to the second hinge housing (200) with a bolt at the other end;

at least one bearing (B) that is coupled to the hinge shaft (300);

a fixed hinge cam (400) that is axially coupled to the hinge shaft (300) and one end of which is inserted into the hollow portion (102) of the first hinge housing (100) and the other end has a fixed contact portion 402 obliquely cut to form an elliptical shape;

a movable hinge cam (500) that is axially coupled to the hinge shaft (300) and has a movable contact portion (502) having a shape corresponding to the fixed contact portion (402) of the fixed hinge cam (400), wherein the movable contact portion (502) rotates along the fixed contact portion (402) so as to be movable in the axial direction in the hinge cylinder (202) of the second hinge housing (200);

a hinge spring (600) that is safely coupled to the inside of the hinge cylinder (202), is disposed between the movable hinge cam (500) and the hinge cylinder (202), and applies an elastic force to the movable hinge cam (500); and a fixing and coupling member (700) that is coupled to the ends of the front board (FB) and the rear board (RB) facing each other with a bolt so as to prevent the hinge shaft (300) from being departing from the first and second hinge housings (100 and 200).

2. The hinge structure of the skateboard according to claim 1, wherein the second hinge housing (200) includes the hinge cylinder (202) to which the hinge spring (600) is safely coupled and of which one end is opened so that the movable hinge cam 500 is movable in the axis direction, and wherein the hinge cylinder includes:

a safe support step (204) that has a step formed at the other end of the hinge cylinder (202) so as to support the hinge spring (600);

a shaft insertion hole (206) that is longitudinally recessed in the axis direction of the safe support step (204) with a reduced diameter and into which an end of the hinge shaft (300) is inserted; and a bolt hole (208) that is formed at the inner end of the shaft insertion hole (206) so as to pass through the second hinge housing (200).

3. The hinge structure of the skateboard according to claim 1, wherein the hinge shaft (300) includes:

a rotational axis portion (310) that is inserted into the hollow portion (102) of the first hinge housing (100) so as to be movable therein; and a movement guiding axis portion 320 that has a diameter smaller than that of the rotational axis portion (310), that guides the movable hinge cam (500) so as to be movable forward and backward in the axis direction, and has a coupling hole (322) formed to be coupled and fixed to the second hinge housing (200) with a bolt.

4. The hinge structure of the skateboard according to claim 1, wherein the fixed hinge cam (400) has a cylindrical shape and includes:

a fixed contact portion (402) of which one end is obliquely cut to form an elliptical surface;

a fixed axis hole (404) that communicate from one end to the other end so as to be axially coupled to the hinge shaft 300; and a fixed protrusion (406) that is inserted into and fixed to the fixing and coupling member (700) coupled to an end of the rear board (RB) and is formed on both edges of the opposite end of the fixed contact portion (402).

5. The hinge structure of the skateboard according to claim 1, wherein the movable hinge cam (500) has a cylindrical shape and includes:

a movable contact portion (502) that is obliquely cut along the elliptical surface of the fixed contact portion (402) of the fixed hinge cam (400) to form an elliptical surface; and a movable axis hole (504) that communicates from one end to the other end so as to be axially coupled to the hinge shaft 300.

6. The hinge structure of the skateboard according to claim 1, wherein the movable contact portion (502) of the movable hinge cam (500) corresponding to the fixed contact portion (402) of the fixed hinge cam (400) is twisted in the obliquely-cut elliptical surface of the fixed contact portion 402 in the angle range of 0 degree to 90 degree about the hinge shaft (300).

7. The hinge structure of the skateboard according to claim 1, wherein the fixing and coupling member (700) includes:

a first fixed plate (710) that is coupled to the end surface of the hollow portion (102) of the first hinge housing at the end of the rear board (RB) with a bolt, has a hinge shaft hole (712) formed at the center, and has fixed key grooves (714) formed on both inner edges of the hinge shaft hole (712);

a second fixed plate (710') that is formed in the second hinge housing (200) at the end of the front board (FB), is coupled to the end surface of the hinge cylinder 202 of which the end is opened along with the end of the second hinge housing (200) with a bolt, and has a hinge shaft hole (712') formed at the center; and a fixing bolt (720) that is inserted into a bolt hole (208) communicating with a shaft insertion hole (206) from the bottom surface of the second hinge housing (200) and is coupled to a coupling hole (322) formed at an end of the movement guiding axis portion (320) of the hinge shaft 300 so as to fix the movement guiding axis portion (320) to the shaft insertion hole (206) of the second hinge housing (200).

8. The hinge structure of the skateboard according to claim 1, wherein a snap ring (SR) is further provided to prevent the at least one bearing (B) disposed at an end of the hinge shaft (300) from departing from the first hinge housing (100).

* * * * *